US006546675B1

(12) United States Patent
Adderton

(10) Patent No.: US 6,546,675 B1
(45) Date of Patent: Apr. 15, 2003

(54) PANEL FIXING SYSTEM

(75) Inventor: David John Adderton, Adelaide (AU)

(73) Assignee: Harkk PTY LTD, Adelaide (AU)

( * ) Notice: Subject to any disclaimer, the term of this patent is extended or adjusted under 35 U.S.C. 154(b) by 0 days.

(21) Appl. No.: 09/600,444

(22) PCT Filed: Jan. 14, 1999

(86) PCT No.: PCT/AU99/00020

§ 371 (c)(1),
(2), (4) Date: Jul. 17, 2000

(87) PCT Pub. No.: WO99/36637

PCT Pub. Date: Jul. 22, 1999

(30) Foreign Application Priority Data

Jan. 16, 1998 (AU) ..... PP 1341

(51) Int. Cl.[7] ..... E04B 2/00

(52) U.S. Cl. ..... 52/71; 52/282.1; 52/239; 52/768; 52/770; 52/775; 52/780; 160/135; 160/187

(58) Field of Search ..... 52/768, 770, 771, 52/775, 780, 781, 71, 582.1, 282.1, 282.5, 239; 160/135, 187, 195, 231.1, 231.2

(56) References Cited

U.S. PATENT DOCUMENTS 3,086,626 A * 4/1963 Bowers ..... 52/204.599
3,633,316 A * 1/1972 Belser ..... 49/384
3,696,855 A * 10/1972 Kira ..... 160/135
3,854,269 A * 12/1974 Hancock ..... 52/282.5 X
3,875,711 A * 4/1975 Palmer ..... 52/239
3,962,827 A * 6/1976 Chaffee ..... 160/135 X
4,120,130 A * 10/1978 Puschkarski ..... 52/282.5
4,774,792 A * 10/1988 Ballance ..... 52/239 X
4,785,565 A * 11/1988 Kuffner ..... 160/135 X
4,968,171 A * 11/1990 Shell ..... 160/135 X

FOREIGN PATENT DOCUMENTS

| | | | |
|---|---|---|---|
| DE | 4307492 | 9/1994 | |
| DE | 29613727 | 10/1996 | |
| DE | 29613727 | 12/1996 | |
| JP | 10061072 | * 3/1998 | ..... E04B/2/74 |
| WO | WO97/01685 | 1/1997 | |
| WO | WO97/39201 | 10/1997 | |

* cited by examiner

*Primary Examiner*—Carl D. Friedman
*Assistant Examiner*—Brian E. Glessner
(74) *Attorney, Agent, or Firm*—The Maxham Firm

(57) ABSTRACT

A panel support assembly 25 comprises a post 10 having at least one elongate recess 12, rotatably supporting a respective panel receiving member 13. The panel receiving member 13 comprising a rod-like member having an internal channel 14 adapted to receive a panel 11. The recess 12 is part-cylindrical and respective panel receiving member 14 is cylindrical, partially fitting within recess 12, so as to allow relative rotation. A pair of panel support assemblies 25, with pairs of panel receiving members 13 facing each other, provides a panel fixing system for fixing a panel 11.

10 Claims, 5 Drawing Sheets

PANEL FIXING SYSTEM

BACKGROUND OF INVENTION

1. Field of Invention

This invention relates to a panel support assembly and a panel fixing system, and in particular to the fixing of panels between posts.

2. Discussion of Related Art

Existing panel fixing systems include upright posts with channels into which the edge of panels locate. In the case of glass panels, silicone sealer is normally used to secure the edges of the glass panels within the channels.

There is some difficulty with such installations. Firstly, the posts need to be accurately located both laterally and angularly to ensure that the channels are aligned. Secondly, as the posts are fixed in position, the panels can only be located by inserting them from the top of the posts and dropping them into place. There may be some difficulties in positioning the panels in this method if the channels on the post do not properly align.

Obviously, it is time consuming to ensure accurate alignment between the posts, and location of the panels in the manner described is also exceedingly difficult.

It is often necessary for there to be an angle between adjacent panels. This means using either an excessively wide channel in the posts, or making a number of different posts with channels at different angles. It is prohibitively costly to produce a range of posts to produce all of the required angles between adjacent panels.

SUMMARY OF THE INVENTION

The invention will find many applications. The most common application is the fixing of glass panels between a plurality of upright posts. This produces a structure which can be used for decorative purposes, as a swimming pool enclosure, as a wind and noise screen or as a balustrade among many examples.

It is an aim of this invention to overcome the problems referred to above, and to provide a panel support assembly and associated panel fixing system which enables easy fixing of panels between post members and to provide a system that allows greater flexibility in terms of relative angles between panels on either side of a post.

According to the present invention, there is provided a panel support assembly for receiving and supporting a panel along its edge comprising:

- a post having an elongate laterally opening part-cylindrical recess extending along its length; and
- an elongate panel edge receiving member having internal walls defining a U-shaped laterally opening channel extending along its length and an outer peripheral wall shaped so as to allow rotation within the recess about a lengthwise axis of the post;
- whereby, in use, a panel edge can be moved into the channel in a direction perpendicular to the lengthwise axis and subsequently the panel edge and receiving member can be rotated about the lengthwise axis together to allow alignment of an opposed edge of the panel with a receiving member of a second panel support assembly.

Preferably, the outer peripheral wall of the receiving member is part-cylindrical in shape.

The angle of the arc defined by the recess in the post may be greater than 180° which in turn means that the panel edge receiving member is held captive within the recess. In other words, the opening of the recess is narrower than the diameter of the panel receiving member. This will act to hold the panel receiving member captive within the recess thereby positively joining the panel edge receiving member to the post.

Alternatively, the width of the recess in the post may be sufficient to allow the panel edge receiving member to pass laterally into the recess through the recess opening. The width may be such that a slight resistance to location within the recess is provided. This enables the panel receiving member to be pushed into the opening of the recess while at the same time providing sufficient holding force to keep it within the recess.

The posts can be of any suitable cross-sectional shape, and ideally would comprise extruded sections produced from material such as aluminum. Most would be produced with recesses on both sides with some posts being produced with recesses on one side.

As the panel edge receiving member is able to rotate with respect to the post, this enables the panel to be positioned within a range of angles defined by the degree of rotation of the panel receiving member with respect to the post. This provides several advantages. One is the ability to correct for small errors of alignment between adjacent posts or to simply allow a panel to be positioned at an angle with respect to adjacent panels.

It also has significant advantages in respect of locating panels between adjacent posts. By ensuring that the channel within the panel edge receiving member is deep enough, one edge of the panel may be located fully within its receiving member, and then the panel and receiving member can be rotated so that the opposite edge can locate within the channel of the second receiving member. Ideally, the second panel receiving member can be rotated so that the second edge of the panel easily locates within the recess. Continued rotation of both receiving members enables the panel to be put into its desired position ready for insertion of the silicone sealant. This assembly process is significantly easier by comparison to known techniques.

DETAILED DESCRIPTION OF THE PREFERRED EMBODIMENTS

In order to fully understand the invention, a preferred embodiment will now be described. However, it should be realised that this invention is not to be confined or restricted to the precise details of this embodiment.

Figure 1:
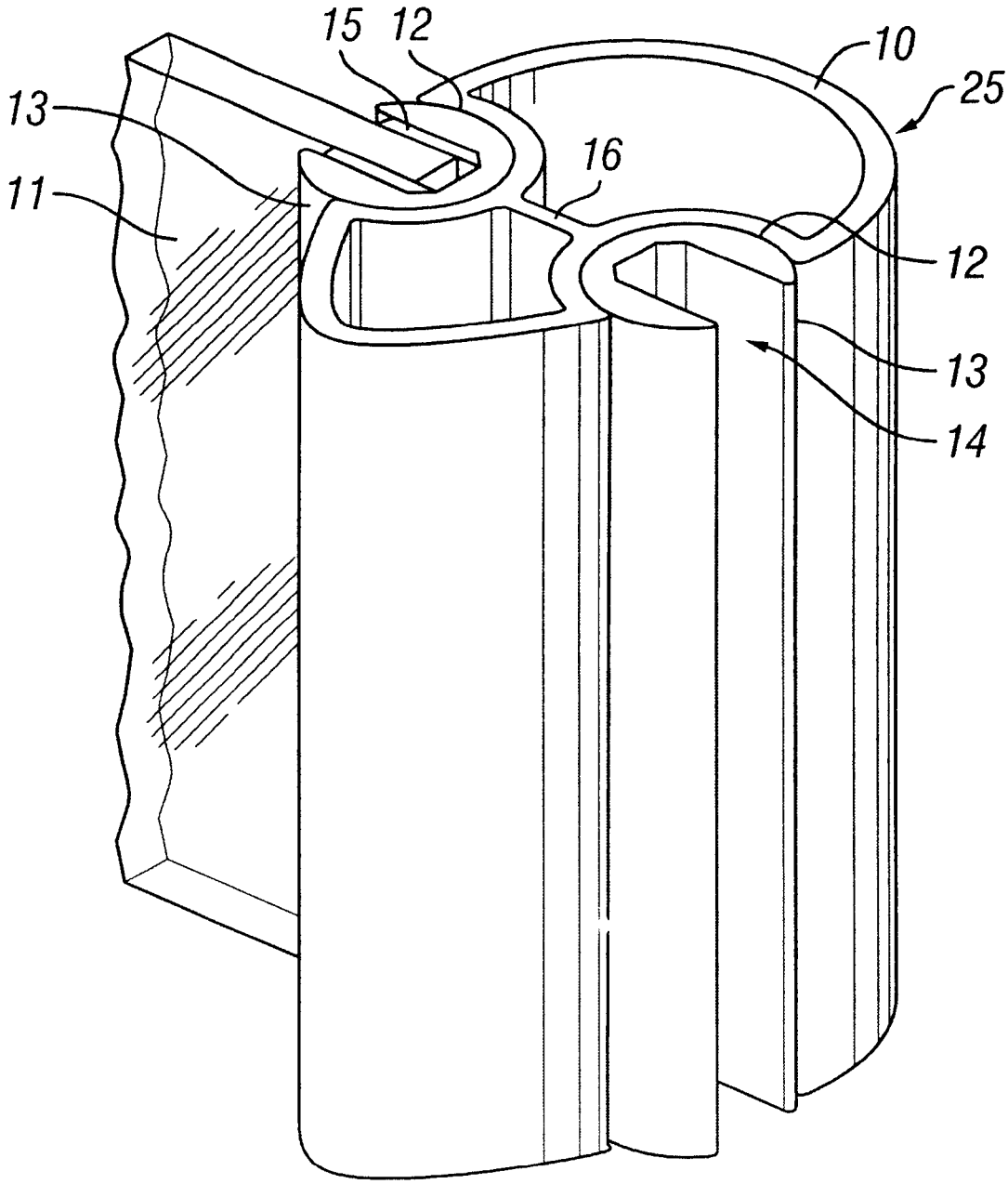
FIG. 1 shows a perspective view of a panel support assembly.

Referring to FIG. 1, there is shown in perspective view a panel support assembly 25 comprising two parts. The first part, a post 10, is a hollow extruded aluminum section. The post 10 has a pair of part-cylindrical recesses 12 formed on either side. The recesses 12 have a generally semi-circular cross-section and have an arc of approximately 180°. The walls of recesses 12 are joined by web 16 which provides additional strength.

Figure 2A:
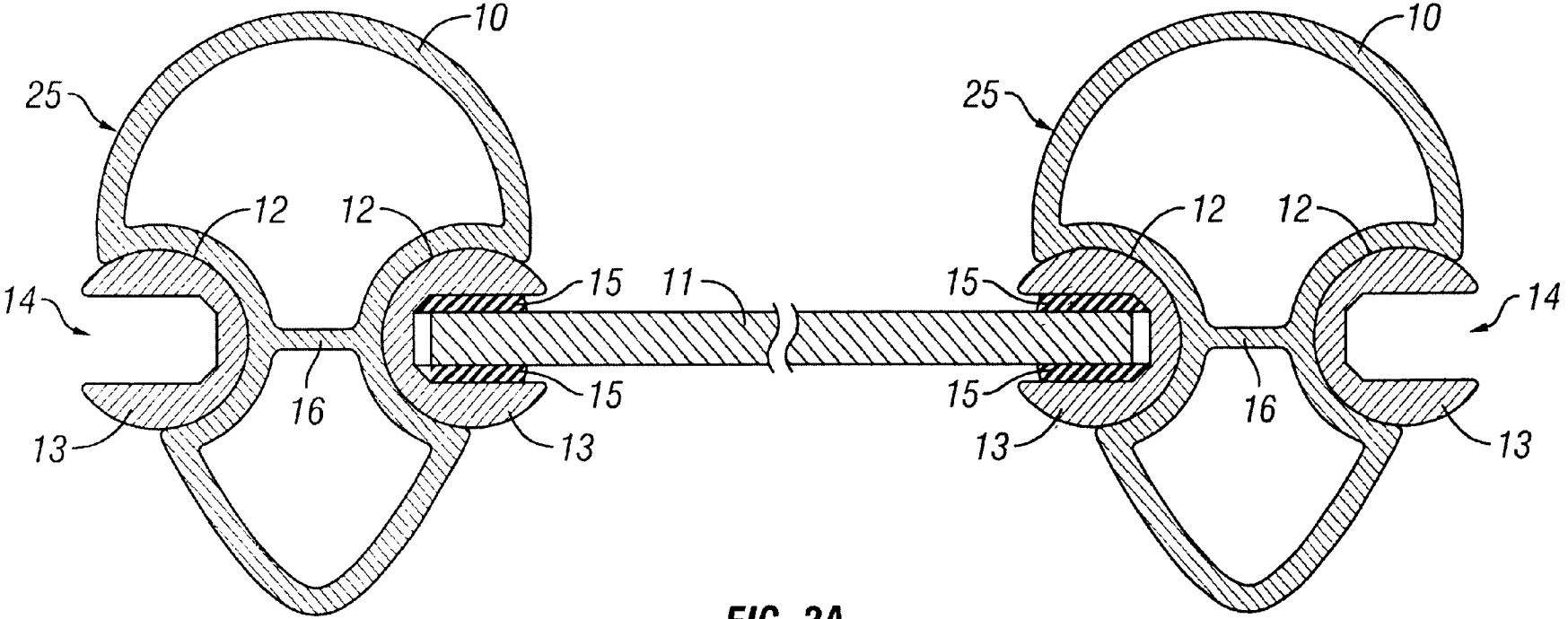
FIG. 2A is a horizontal sectional view through a panel connected laterally between two support assemblies.
Figure 2B:
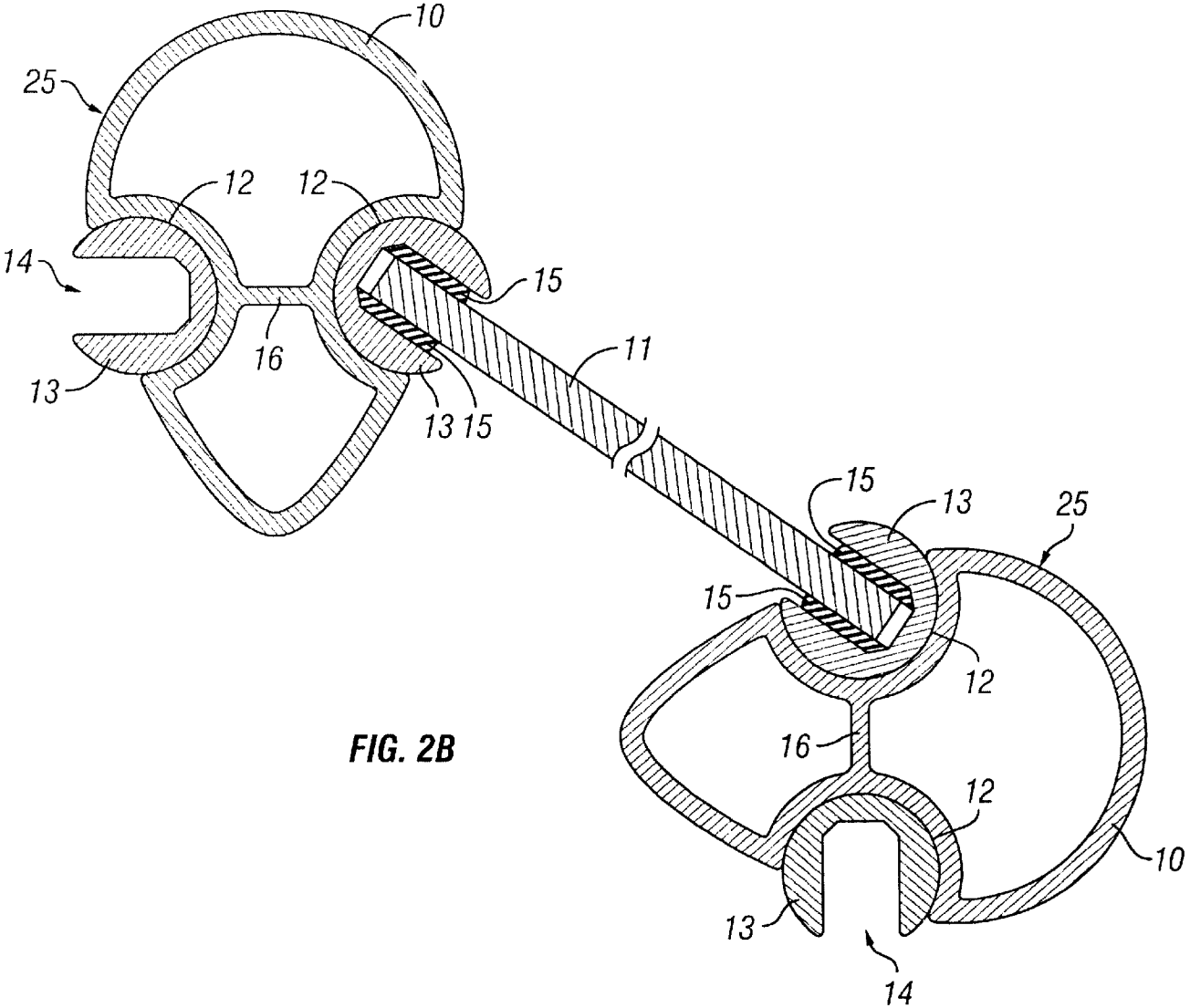
FIG. 2B is a horizontal sectional view through a panel connected between two support assemblies at an angle.

The panel support assembly further comprises panel edge receiving members 13 which locate within the recesses 12. Each of the receiving members 13 are elongate members having outer peripheral walls part-cylindrical in shape to enable location within the recesses 12. The receiving members 13 have internal walls defining a U-shaped laterally opening channel extending along their lengths within which the panel 11 locates as shown in FIG. 2. The channel 14 does not need to be along the full length of the panel receiving member 13 particularly if the height of the panel 11 differs from the height of the post 10.

The receiving member 13 is able to rotate within the part-cylindrical recess 12, enabling the angle of the panel with respect to the post 10 to vary considerably. This is shown in FIGS. 4*a* and 4*b* which show positioning of channels 14 to enable the panel 11 to form the required angle.

Figure 3:
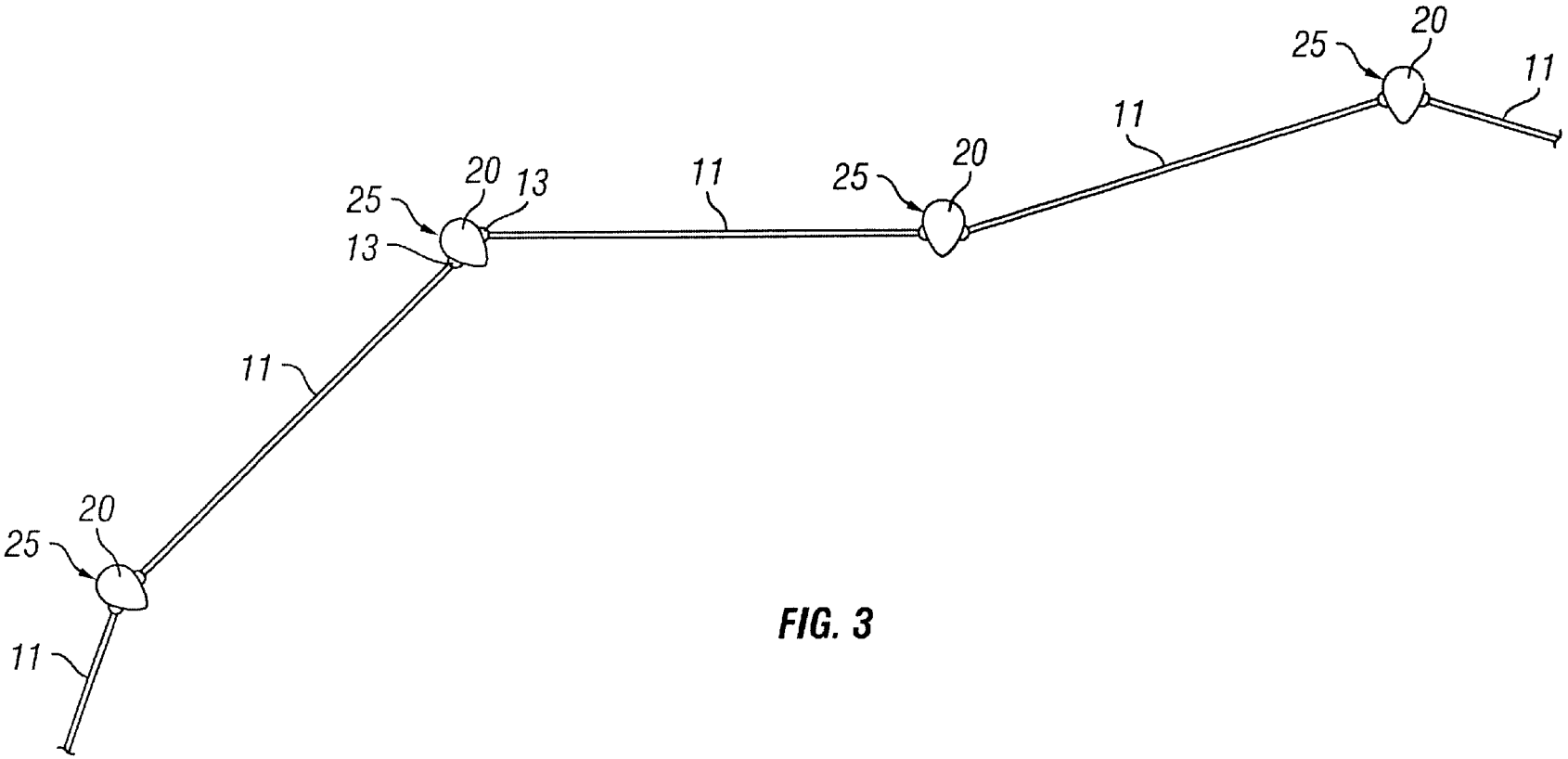
FIG. 3 shows a plan view of a series of panels and their respective panel support assemblies.

As seen in FIG. 2, the panel fixing system comprises of posts 10 with a panel 11 located between. A number of panels and corresponding posts 10 may be used to complete a structure as shown in FIG. 3.

Figure 4A:
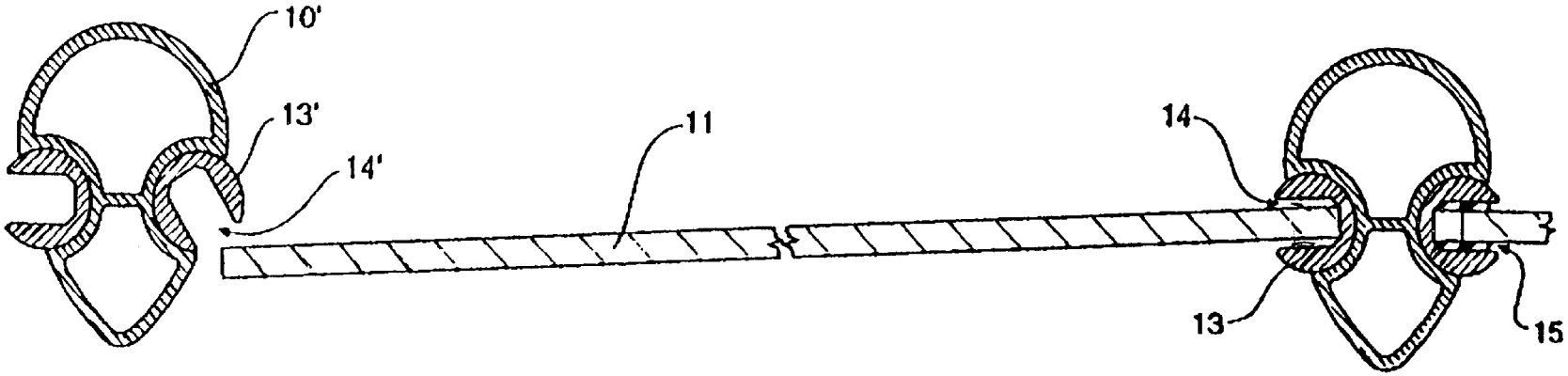
FIGS. 4*a* and 4*b* show a plan view of a horizontal cross-section through a panel and its two panel support assemblies at successive assembly positions.
Figure 4B:
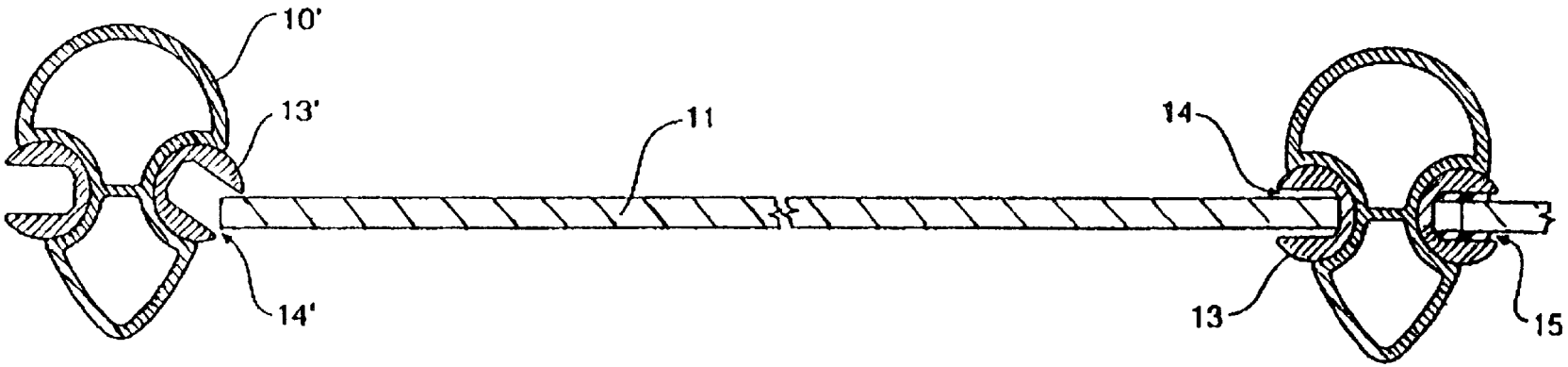

Referring to FIG. 4*a* and 4*b* in order to locate the panel 11 between adjacent-posts, one panel receiving member 13 is rotated so that the channel 14 is adjacent one side of the recess 12. The edge of the panel is located within the channel 14, and then the combination of the panel 11 and panel receiving member 13 are rotated so that the opposite edge locates within its respective panel receiving member 13'. That particular panel receiving member 13' can also be rotated to position the opening so that the edge of the panel 11 can easily locate within the channel 14'. The overall width of the panel 11 may be slightly shorter than the distance between the base of adjacent channels 14 and 14' which assists in location of the panel in the manner described above. As can be seen in FIGS. 4*a* and 4*b,* there is a clearance fit when the edges of panel 11 are coupled into channels 14 and 14'. This enables the panel to be rotated into final position, coupled between the posts, which are a fixed distance apart. By assembling a plurality of panels 11 between panel support assemblies 25, a screen wall can be created such as shown in FIG. 3. Caps 20 can be fitted to the tops of posts 10 to produce a sealed and aesthetically pleasing assembled screen.

Once the panel 11 is in position, silicone sealant 15 can be located within the channel 14 to hold the panel 11 securely in place.

There may be a slight interference fit between the panel support 13 and part-cylindrical recess 12 which still allows for rotation of the panel receiving member 13 while at the same time preventing clearance that might cause movement or rattling of the assembly.

The invention will obviously find numerous applications ranging from glass screen or walls, balustrades, or any other application where panels need to be held between support posts. In addition to using the invention on horizontal surfaces, it will be equally suited to inclines such as the sides of stairs or on sloping ground.

While the present invention has been described in terms of a preferred embodiment in order to facilitate better understanding of the invention, it should be appreciated that various modifications can be made without departing from the principles of the invention. Therefore, the invention should be understood to include all such modifications within its scope.

What is claimed is:

1. A supported panel assembly comprising:

a panel having first and second parallel edges and two opposite sides;

a pair of spaced apart panel support assemblies supporting respective first and second edges, each panel support assembly comprising;

a post having an elongate laterally opening part cylindrical recess extending along its length; and an elongate panel edge receiving member having internal walls defining a U-shaped laterally opening channel extending along its length and an outer peripheral wall shaped so as to allow rotation with the recess about a lengthwise axis of the post, the channel sized to receive, and receiving, an edge of the panel with a clearance fit, the clearance fit comprising a gap between one of the sides of the panel and the U-shaped channel, said receiving member having a diameter;

wherein after fixing the posts in a spaced apart parallel relationship, the first edge of the panel is movable into a first of the pair of channels in a direction perpendicular to the respective lengthwise axis and subsequently the panel edge and receiving member can be rotated about the respective lengthwise axis together to allow insertion of the second edge of the panel into the receiving member of the second panel support assembly while the first edge remains within the first channel.

2. A supported panel assembly according to claim 1, wherein the outer peripheral wall of each receiving member is part-cylindrical in shape.

3. A supported panel assembly according to claim 2, wherein each U-shaped channel extends into the receiving member a distance of at least two thirds of the diameter of the receiving member.

4. A supported panel assembly according to claim 3, wherein each recess is semi-cylindrical in shape.

5. A supported panel assembly according to claim 4, wherein each receiving member is rotatable within the recess through at least 80 degrees before the opening of the channel is partially obscured.

6. A supported panel assembly according to claim 4, and further comprising two said recesses and two said receiving members wherein the post is hollow and further comprises a web joining inner walls of the recess.

7. A supported panel assembly according to claim 5, and further comprising two said recesses and two said receiving members wherein the post is hollow and further comprises a web joining inner walls of the recess.

8. A supported panel assembly comprising:

a panel having first and second parallel edges and two opposite sides;

a pair of spaced apart panel support assemblies supporting respective first and second edges, each panel support assembly comprising:

a post having an elongate laterally opening part-cylindrical recess extending along its length; and an elongate panel edge receiving member having internal walls defining a U-shaped laterally opening channel extending along its length and an outer peripheral wall shaped so as to allow rotation with the recess about a lengthwise axis of the post, the channel sized to receive, and receiving, an edge of the panel with a clearance fit, the clearance fit comprising a gap between one of the sides of the panel and the U-shaped channel, said receiving member having a diameter;

wherein the receiving member is removable from the recess in a direction at right angles to the post, and wherein after fixing the posts in a spaced apart parallel relationship, the first edge of the panel is movable into a first of the pair of channels in a direction perpendicular to the respective lengthwise axis and subsequently the panel edge and receiving member can be rotated about the respective lengthwise axis together to allow insertion of the second edge of the panel into the receiving member of the second panel support assembly while the first edge remains within the first channel.

9. A supported panel assembly according to claim 8, wherein the outer peripheral wall of the receiving member is part-cylindrical in shape.

10. A method of fixing a panel in an assembly comprising:

providing a panel having first and second parallel edges and two opposite sides;

fixing a pair of spaced apart panel support assemblies with respect to each other, said first and second assemblies supporting respective first and second edges respectively, each panel support assembly comprising:

a post having an elongate laterally opening part-cylindrical recess extending along its length; and an elongate panel edge receiving member having internal walls defining a U-shaped laterally opening channel extending along its length and an outer peripheral wall shaped so as to allow rotation with the recess about a lengthwise axis of the post, the channel sized to receive an edge of the panel with a clearance fit, said receiving member having a diameter; laterally moving the first edge of the panel into a first of the pair of channels in a direction perpendicular to the respective lengthwise axis;

subsequently rotating the panel edge and receiving member about the respective lengthwise axis together to allow insertion of the second edge of the panel into the receiving member of the second panel support assembly while the first edge remains within the first channel; and rotating the receiving member of the second panel support assembly into position.

* * * * *

UNITED STATES PATENT AND TRADEMARK OFFICE

CERTIFICATE OF CORRECTION

PATENT NO. : 6,546,675 B1
APPLICATION NO. : 09/600444
DATED : April 15, 2003
INVENTOR(S) : David John Adderton It is certified that error appears in the above-identified patent and that said Letters Patent is hereby corrected as shown below:

Column 4, claim 1, line 13, change “with” to --within--
Column 4, claim 8, line 61, change “with” to --within--
Column 6, claim 10, line 6, change “with” to --within--

Signed and Sealed this

Thirty-first Day of July, 2007

JON W. DUDAS
*Director of the United States Patent and Trademark Office*